United States Patent [19]

Ball

[11] 3,989,872

[45] Nov. 2, 1976

[54] PLASMA SPRAY POWDERS

[75] Inventor: Richard J. Ball, Hammond, Ind.

[73] Assignee: United Technologies Corporation, Hartford, Conn.

[22] Filed: Dec. 19, 1974

[21] Appl. No.: 534,338

[52] U.S. Cl. ..... 428/404; 427/34; 428/403

[51] Int. Cl.[2] ..... B32B 1/00; B05D 1/12

[58] Field of Search..... 117/46 FS, 100 B, 105.2; 428/403, 404; 427/34

[56] References Cited

UNITED STATES PATENTS

| | | | |
|---|---|---|---|
| 3,431,141 | 3/1969 | Eorgan | 117/46 FS X |
| 3,442,690 | 5/1969 | Peake et al. | 117/100 B |
| 3,607,343 | 9/1971 | Longo et al. | 117/100 B X |
| 3,617,358 | 11/1971 | Dittrich | 117/100 B X |
| 3,730,756 | 5/1973 | Kunda et al. | 117/100 B X |

OTHER PUBLICATIONS

Nelson, R. L., et al. "Preparation and Properties of Powders for Flame and Plasma Spraying," Chemical Abstracts vol. 81, abs. 157650g, (1973).

*Primary Examiner*—George F. Lesmes
*Assistant Examiner*—Charles E. Lipsey
*Attorney, Agent, or Firm*—Richard N. James

[57] ABSTRACT

Fine powders comprising yttria stabilized zirconia powders encased in a thin calcia shell are provided for plasma spray coating processes.

1 Claim, No Drawings

PLASMA SPRAY POWDERS

BACKGROUND OF THE INVENTION

The present invention relates in general to the coating arts and, more particularly, to fine powders especially suited to the generation of coatings by plasma spray techniques.

Plasma spray coating techniques are well recognized in the art and are, in fact, widely used in industry. In a typical plasma spray operation an inert gas, such as argon, is electrically excited in a suitable spray gun resulting in a high temperature plasma. The plasma temperatures may be on the order of 20,000° F. and very high plasma velocities exiting the gun are possible.

Plasma spray coating procedures utilize the simple mechanism of injecting suitable coating powders in this hot, high velocity plasma stream wherein the particles are heated and propelled to the surface to be coated or where the deposit is to be formed. Because the particles are impacted at high temperature against the surface, dense adherent coatings may be achieved.

Plasma sprayed zirconia has found utility as a thermally insulative coating on certain gas turbine engine components. The typical zirconia spray powders in current use are stabilized with either calcia or magnesia, usually at about the 5 percent by weight stabilizer level. Basically, the stabilizer is used to generate and maintain the zirconia in a cubic metallographic structure for mechanical property reasons, including thermal shock resistance.

Unfortunately, although the calcia/magnesia stabilized zironcia may be readily sprayed and exhibits stability at lower temperatures, the stability of the composition at more elevated temperatures, as may be encountered in some gas turbine engine applications, is marginal.

It is also known that yttria will stabilize zirconia and will afford stability to higher temperature levels than either calcia or magnesia. However, spray trials with yttria stabilized zirconia soon reveal very low spray efficiencies with this composition, particularly in an interparticle bonding sense.

SUMMARY OF THE INVENTION

The present invention relates to plasma spray powders which consist primarily of yttria stabilized zirconia particles characterized by a very high spray efficiency. It contemplates plasma spray powders comprising a plurality of individual composite particles of yttria stabilized zirconia encased in a thin shell or coating of a high vapor pressure ceramic material, preferably calcia.

DESCRIPTION OF THE PREFERRED EMBODIMENTS

As previously described, the preferred plasma spray powders comprise yttria stabilized zirconia particles encased within a thin shell of calcia. The stabilizers are known to be effective in performing their function in zirconia when present in the order of a few mole percent. Yttria, for example, when present in an amount of 2–4 mole percent will stabilize zirconia. Calcia is the particularly preferred particle coating material since it, of course, is also an effective stabilizer.

Powder particle sizes vary depending upon the particular plasma spray equipment available and the experiences and preferences of the coating party. A typical powder particle size distribution, determined in accordance with ASTM B214, suitable for many plasma spray operations, is as follows:

| Sieve | % by weight Min. | Max. |
|---|---|---|
| +140 | — | 1 |
| +200 | — | 15 |
| +325 | 75 | — |
| −325 | — | 25 |

+indicates retained on sieve
−indicates passing sieve

While the reasons for the excellent results with the powders of the present invention are not fully understood, calcia appears to exhibit three characteristics of importance thereto, viz., a relatively high vapor pressure, an ability to promote interparticle bonding, and inherently an ability to stabilize zirconia. Good interparticle bonding is essential not only to furnishing high spray efficiencies but also to the development of dense, adherent deposits. The high vapor pressure of calcia minimizes the risk of loss at the high spraying temperatures associated with plasma spray procedures. This apparently leads to retention of the thin calcia shell through the spraying operation and, concomitantly, permits the employment of a calcia shell of minimum thickness on the individual particles, thereby permitting the yttria to afford the primary stabilizing function. Finally calcia is compatible with the yttria/zirconia composition and does not act as an impurity therein but to the contrary, to the extent that it interacts with the yttria/zirconia, exhibits a beneficial stabilizing function of its own.

Following the unsatisfactory experience with the yttria stabilized zirconia powders without special treatment, a quantity of these powders were treated to form a thin calcia shell thereon. This was accomplished by first forming a deposit of calcium carbonate on the individual particles and converting the calcium carbonate to calcium oxide by the simple act of heating. Calcium carbonate can, as is known, be completely converted to calcium oxide at 600° C.

In the spraying of the calcia coated zirconia/yttria powders no special techniques were necessary. Plasma spray parameters are, of course, usually selected as a function of the equipment being used, the powders being sprayed, the substrate being coated, and the nature of the coating desired including its structure and thickness. These parameters are well recognized by those skilled in the plasma spray arts.

Trials with the powders of this invention have demonstrated that spray efficiencies of almost 100 percent are possible. Depending, of course, on the circumstances, the availability of the subject powders may provide other benefits as well. For example, the use of these powders may allow utilization of detuned or less carefully controlled spraying parameters. Further, particles of larger size, which might be used for example in the development of abradable deposits, may be sprayed because of the efficiencies possible.

Although the invention has been described in detail in connection with certain preferred embodiments and examples, certain modifications may occur to those skilled in the art within the true spirit and scope of the invention.

What is claimed is:

1. Plasma spray powder which comprises a plurality of composite particles which consist essentially of an yttria stabilized zirconia core encased in a thin calcia shell.

* * * * *